US006728387B1

(12) United States Patent
Polito et al.

(10) Patent No.: US 6,728,387 B1
(45) Date of Patent: Apr. 27, 2004

(54) UNDER-THE-EAR MOUNTING HEADSET

(75) Inventors: Fred Italo Polito, Santa Cruz, CA (US); Soohyun Ham, Santa Cruz, CA (US); Gerald W. Skulley, Aptos, CA (US)

(73) Assignee: Plantronics, Inc., Santa Cruz, CA (US)

( * ) Notice: Subject to any disclaimer, the term of this patent is extended or adjusted under 35 U.S.C. 154(b) by 0 days.

(21) Appl. No.: 10/153,403

(22) Filed: May 22, 2002

(51) Int. Cl.[7] ..... H04R 25/00
(52) U.S. Cl. ..... 381/375; 381/379
(58) Field of Search ..... 381/381, 374, 381/375, 379, 380, 371, 370; 379/430, 433.02, 433.03, 432, 440; 455/575.1, 575.2, 575.4, 575.6

(56) References Cited

U.S. PATENT DOCUMENTS 5,210,791 A * 5/1993 Krasik
5,414,769 A * 5/1995 Gattey et al.
5,761,298 A * 6/1998 Davis et al.

* cited by examiner

*Primary Examiner*—Sinh Tran
(74) *Attorney, Agent, or Firm*—Peter Hsieh

(57) ABSTRACT

A headset includes: a body; an upper wing extended from the body; a lower wing extended from the body; a speaker capsule coupled to the upper wing so that the speaker capsule can be positioned near an ear; and an ear bud coupled to the upper wing so as to be positioned on an opening of the concha of the ear. The lower wing is movable up and down pivotally on an interface between the body and the lower wing and the lower wing is rotatable about a longitudinal axis running from a first end to a second end of the lower wing. The rotation allows a first surface of the lower wing to accommodate one type of ear, and a second surface of the lower wing to accommodate another type of ear. The upper wing is further extendable from the body so as to position the ear bud on the opening of the concha of the user's ear. The headset further includes a microphone embedded in the upper wing, a voice tube extended from the upper wing, and an on-line indicator. Instead of the embedded microphone, an external microphone can be attached to the upper wing. The ear bud may float to be positioned on the opening of the concha and can be integrated into the speaker capsule.

23 Claims, 4 Drawing Sheets

UNDER-THE-EAR MOUNTING HEADSET

BACKGROUND

The present invention relates to telecommunication headsets and in particular, to a UTE (under-the-ear) headset, which is held to the ear of an operator, for telephone call type environments and individual voice communication.

A conventional OTE (over-the-ear) headset usually requires a retaining device, typically referred to as an ear-hook, to be fitted over the apex of the ear to secure the headset when an operator is wearing the headset. This OTE headset has several structural limitations that may cause the operator discomfort when he or she wears it.

First, the OTE headset generally requires a large clamping force over the operator's ear to keep the headset from falling from the operator's ear. In the OTE headset, the weight of the headset is largely suspended from the sensitive apex of the ear, which may also bear the additional weight of the user's eyewear. Thus, this strong clamping force at the apex of the ear may, especially after an extended period of use, cause discomfort and/or pain for the user. Secondly, the ear-hook of the OTE headset often requires the ability to be moved in a complex manner in several directions so as to be capable of being worn comfortably by users who have different ear shapes. The mechanisms required to permit these complex movements or adjustments are quite costly to manufacture and quite cumbersome for the users to manipulate into a comfortable fit. The difficulty inherent to the adjustment of these mechanisms can easily lead to frustration and dissatisfaction on the part of the users.

Therefore, a headset that is comfortable on the operator's ear after an extended wearing of the headset is in demand. Further, the headset must be easy for various users to adjust-on their ears.

SUMMARY

An aspect of the present invention provides a headset for communication. The headset includes: an upper wing having a first end and a second end; a lower wing having a first end and a second end; a speaker capsule coupled to the upper wing so that the speaker capsule can be positioned near an ear; and an ear bud coupled to the upper wing so as to be capable of being. positioned on an opening of the concha of the ear. The second end of the lower wing is connected to the second end of the upper wing so that the lower wing pivotally moves up and down relative to the upper wing. The lower wing contacts the behind surface of the ear's outside pinna when the lower end moves up.

The lower wing rotates around an axis extending from the first end to the second end of the lower wing. In addition, a first surface of the lower wing is shaped to accommodate one type of ear, and a second surface of the lower wing is shaped to accommodate another type of ear. The first surface is separated from the second surface by a 180 degree rotation of the lower wing.

In one embodiment, the headset further includes a Ad microphone embedded in the upper wing, a voice tube extended from the upper wing, and an on-line indicator. Instead of the embedded microphone, an external microphone can be attached to the upper wing. The upper wing is extendable so that when the ear bud is positioned on the opening of the concha of the ear, the location of the microphone can be adjusted by the user. The ear bud may float to position on the opening of the concha and can be integrated into the speaker capsule.

Another embodiment of the headset includes: a body; an upper wing extended from the body; a lower wing extended from the body; a speaker capsule coupled to the upper wing so that the speaker capsule can be positioned near an ear; and an ear bud coupled to the upper wing so as to be capable of being positioned on an opening of a concha of the ear.

In still another embodiment, the lower wing moves up and down pivotally on an interface between the body and the lower wing and rotates. The rotation allows a first surface of the lower wing to accommodate one type of ear, and a second surface of the lower wing to accommodate another type of ear. The first surface is rotated from the second surface about 180 degrees about an axis extending from a first end to a second end of the lower wing. The upper wing is extendable from the body so that when the ear bud is positioned on the opening of the concha of the ear, the location of the microphone can be adjusted by the user.

The headset further includes a microphone embedded in the upper wing, a voice tube extended from the upper wing, and an on-line indicator. Instead of the embedded microphone, an external microphone can be attached to the upper wing. The ear bud, when integrated into the speaker capsule, may float within the speaker capsule's boundary to a comfortable position within the opening of the concha.

BRIEF DESCRIPTION OF THE DRAWINGS

Use of the same reference symbols in different drawings indicates similar or identical items.

DETAILED DESCRIPTION

The present invention is directed to a light, compact UTE (under-the-ear) headset that can be easily secured to the ear of the operator. In order to address the discomfort and the complex adjustment in the traditional OTE headset, the UTE headset of the present invention employs advanced articulation geometry, which includes only one friction hinge which enables a position of the UTE headset to adjust upward to fit under and behind the pinna of the user's ear.

Figure 1:
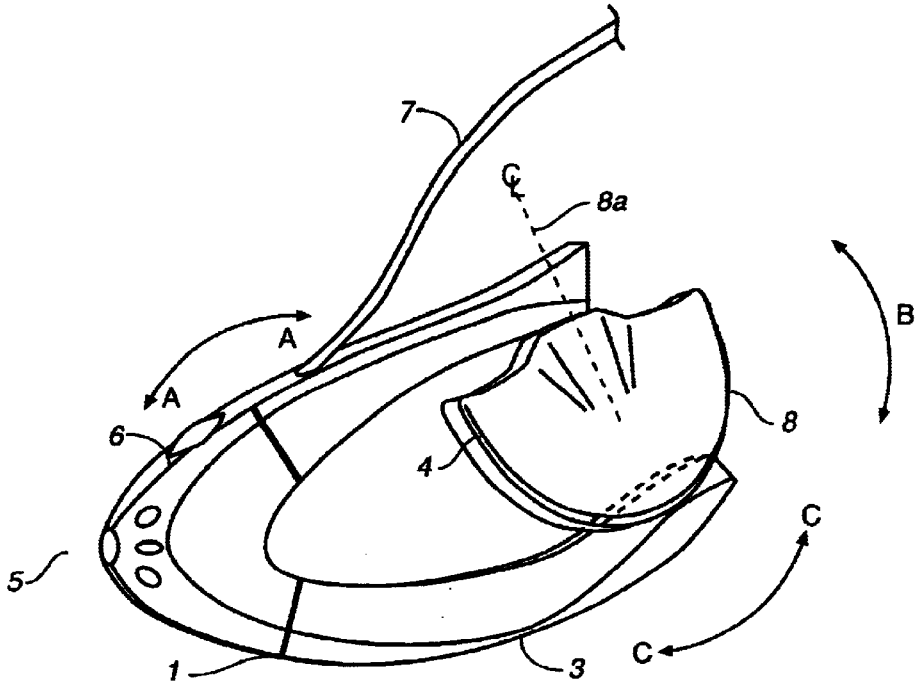
FIG. 1 is a perspective view of a UTE headset in accordance with an embodiment of the present invention.
Figure 2:
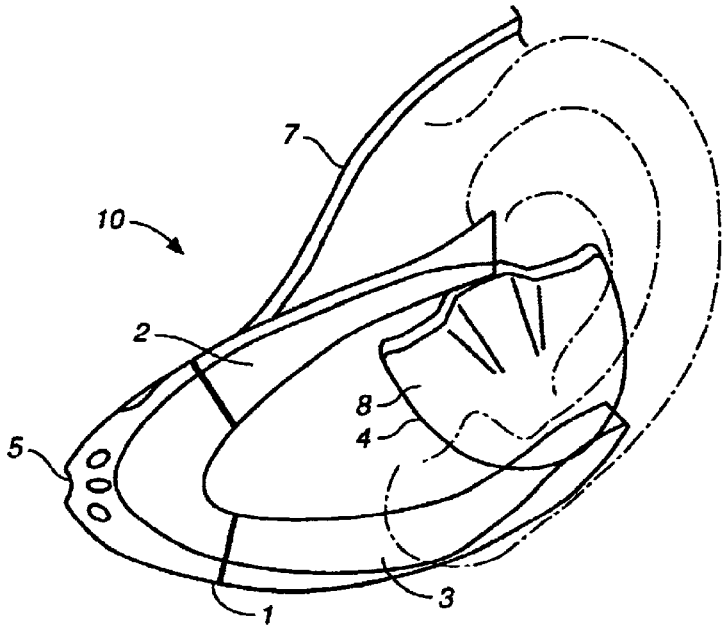
FIG. 2 illustrates the positioning of the UTE headset of FIG. 1 on an ear.

As shown in FIGS. 1 and 2, a UTE headset 10 is mounted to the ear by placing an ear bud 8 in the concha of the inner ear and to the low-behind surface of the ear outside pinna. This mounting location allows for minimal clamping forces to be applied to less sensitive portions of the ear, resulting in a better fitting and more stable headset that can be worn comfortably for a long time. In addition, the geometry of UTE headset 10 can accommodate the $5^{th}$ to $95^{th}$ percentile of human ear size in a comfortable manner and with minimal adjustment.

In accordance with an embodiment of the present invention, UTE headset 10 includes a generally V-shaped body 1 which interconnects an upper wing 2 and a lower wing 3 of headset 10. Upper wing 2 is connected to the upper end of V-shaped body 1. Ear bud 8 and a speaker capsule 4 are mounted on upper wing 2. Lower wing 3 is connected to the lower end of V-shaped body 1. Of course, the shape of body 1 can vary. Body 1 can be a U-shape or any other appropriate shape as long as upper wing 2 and lower wing 3 are in the appropriate positions. Upper wing 2 is coupled to body 1 so as to move to and from body 1 as shown by arrow 'A'. Lower wing 3 is coupled to body 1 so as to move up and down pivotally relative to body 1 and upper wing 2 as shown by arrow 'B'. The interface between body 1 and lower wing 3 acts as a hinge for the pivotal movement of lower wing 3. Ear bud 8, which sits on the concha of a human ear, and speaker capsule 4, are coupled to upper wing 2 so as to be able to rotate at least 180° about the centerline 8*a* (and preferably a few degrees more to allow a user to adjust the position of ear bud 8 for optimum fit and comfort). This allows a user to place the UTE headset on either the right or left ear with no degradation in comfort or fit. Alternatively, ear bud 8, in another embodiment, has speaker openings two transmit sound on both sides of the ear bud. This allows the UTE headset to be placed with equal effectiveness on either ear. Ear bud 8, in this embodiment, is also capable of being rotated a lateral axis parallel to arrow A—A in FIG. 1 to allow the user to adjust ear bud 8 for proper fit and comfort. In this embodiment, the ear bud 8 can, if desired by the user, actually be placed partially in the concha of the ear.

As another option, the use can place only the lower portion of the speaker capsule 8 in the cavum of the ear. This provides a secure and stable fit for the speaker capsule in the ear.

Ear bud 8 which contains the speaker capsule can also rotate in the directions shown by arrows C—C about an axis perpendicular to the sheet of the drawing in FIG. 1 to allow the user to further optimize fit and comfort.

As a feature of one embodiment of this invention, the speaker grill is located in the lower portion of the capsule, which is tucked in the ear. This allows sound to travel directly into the eardrum.

Preferably, the speaker is mounted vertically in the capsule, so that the face of the speaker is parallel to the side of the user's face. However other mountings of the speaker can be used if desired.

As shown in FIG. 1, speaker capsule 4 is suspended from the upper portion of upper wing 2 and can be positioned over the opening of the concha. Headset 10 further includes a microphone 5 embedded in body 1, an on-line indicator 6, and a cord 7 which carries the voice signal to and from the headset.

Referring to FIGS. 1 and 2, when headset 10 is worn on the ear, lower wing 3 is moved down. Ear bud 8 sits on the concha of the ear, and the length of upper wing 2 is adjusted by the movement of upper wing 2 along arrow 'A'. Then, lower wing 3 moves up until it touches the behind surface of the lower portion of the pinna of the user's ear. A spring mechanism (not shown) can be employed to control the up-and-down movement of lower wing 3 when properly positioned, and thus to hold upper and lower wings 2 and 3 together, resulting in minimal pressure on the inside of the lower portion of the concha and on the outside of the lower portion of the pinna. In order for headset 10 to hold on the ear, ear bud 8 is plugged and fixed in the concha, and lower wing 3 when properly positioned, provides a support behind the lower portion of the pinna, which prevents ear bud 8 from unplugging from the ear.

Figure 3:
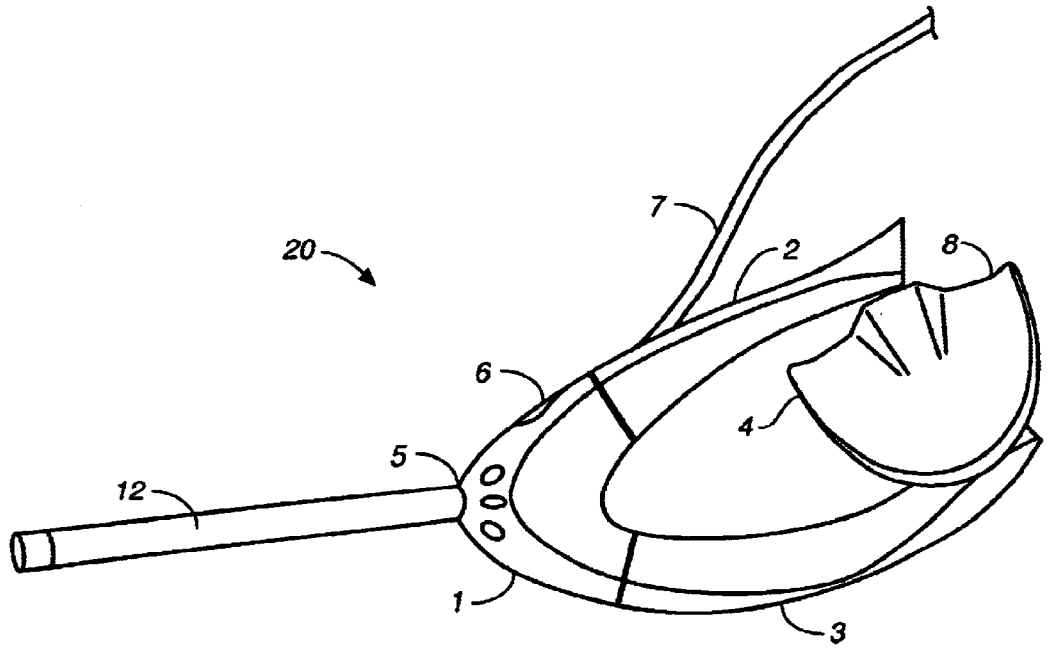
FIG. 3 is a perspective view of a UTE headset with a voice tube in accordance with another embodiment of the present invention.
Figure 4:
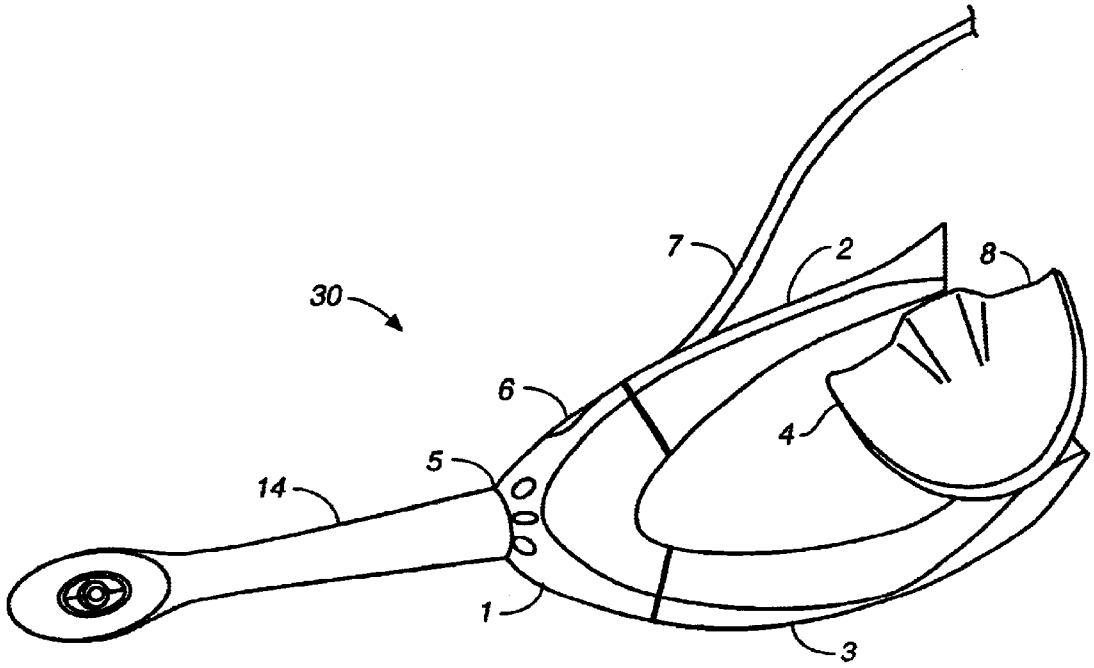
FIG. 4 is a perspective view of a UTE headset with an extended microphone in accordance with still another embodiment of the present invention.

FIGS. 3 and 4 show a headset 20 with a voice tube 12 and a headset 30 with an external microphone 14, respectively. Other components of headsets 20; and 30 are similar to those of headset 10 of FIG. 1. Voice tube 12 (FIG. 3) and external microphone 14 (FIG. 4) are attached to body 1 to provide enhanced acoustic performance in high noise environments.

Figure 5:
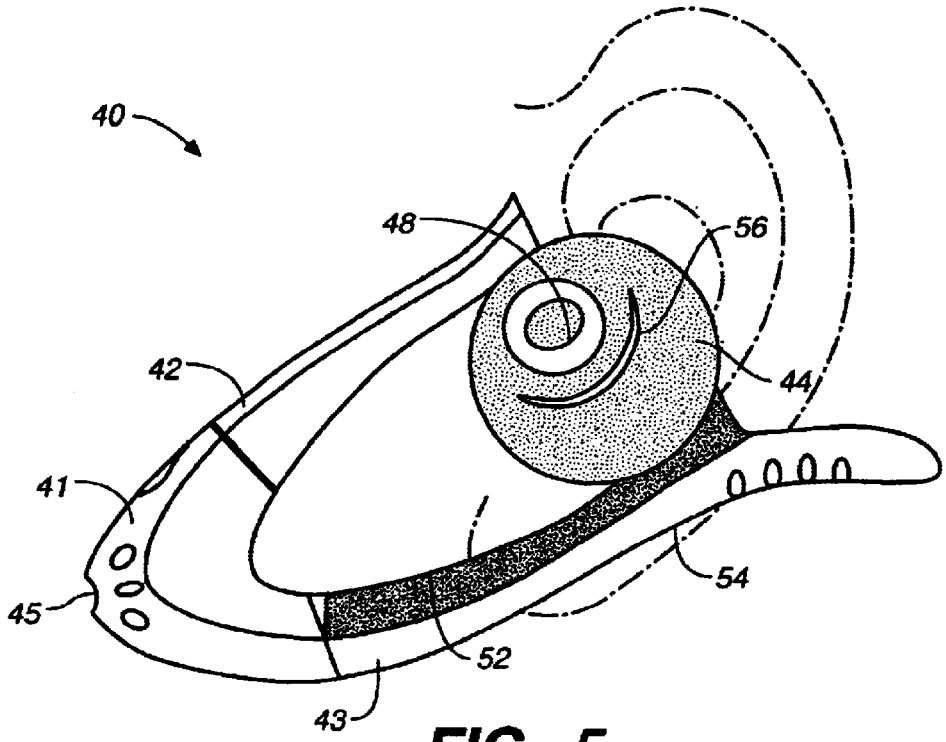
FIG. 5 is a side view of a UTE headset with a double-sided lower wing in accordance with still another embodiment of the present invention.
Figure 6:
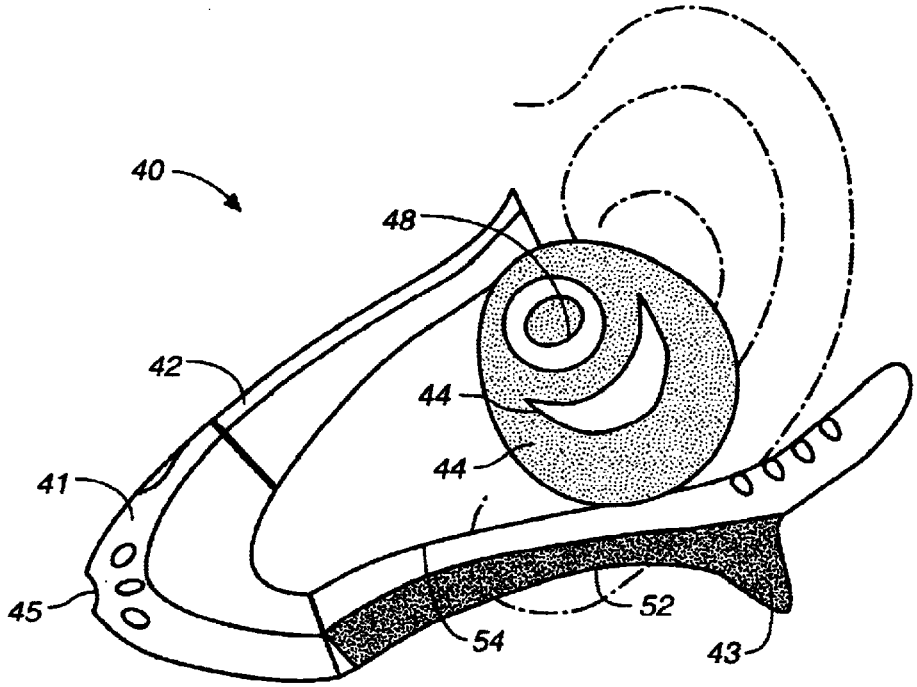
FIG. 6 is another side view of the UTE headset of FIG. 5.
Figure 7B:
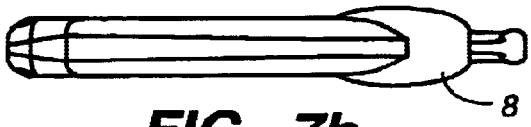
FIGS. 7*a* to 7*f* show views of a UTE headset in accordance with this invention, from all six sides.
Figure 7A:
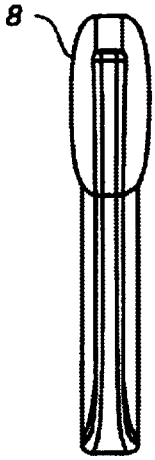
Figure 7C:
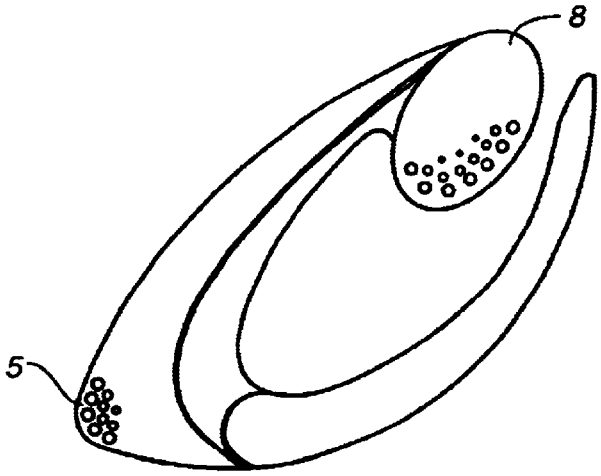
Figure 7E:
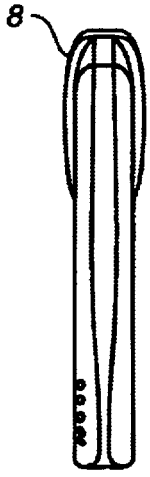
Figure 7D:
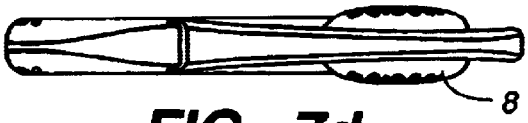
Figure 7F:
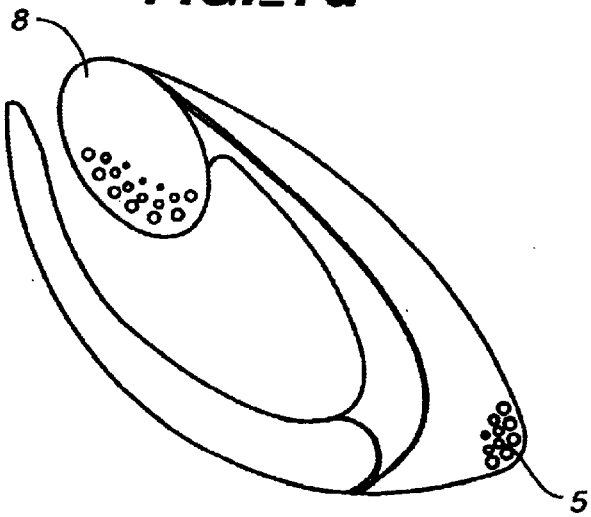

FIGS. 5 and 6 show another UTE headset 40 in accordance with another embodiment of the present invention. Headset 40 includes a body 41 (shown curved about approximately a 135° arc, but which, again, can be any appropriate shape) which interconnects an upper wing 42 and a lower wing 43 of headset 40. Upper wing 42 is connected to an upper end-of body 41 in the same manner and has mounted thereon an ear bud 48 and a speaker capsule 44. Lower wing 43 is connected to a lower end of body 41. Upper wing 42 is coupled to body 41 as upper wing 2 (FIG. 1) is, coupled to body 1. (FIG. 1). Lower wing 43 is coupled to body 41 in the same manner as lower wing 3 is coupled to body 1 (FIG. 1). Headset 10 further includes a microphone 45 embedded in body 41.

Lower wing 43 does not only pivotally move up and down relative to body 41 in the same manner as does lower wing 3 (as shown in FIG. 1) relative to body 1, but also rotates around the longitudinal axis extending from one end to the other end of lower wing 43. Lower wing 43 has two surfaces 52 and 54. Surface 52 is short, and surface 54 is long. The 180 degree rotation of lower wing 43 about its longitudinal axis allows either one of surfaces 52 and 54 of lower wing 43 to press against and be supported by the back surface of the lower portion of the pinna. FIG. 5 illustrates short surface 52 touching the back lower portion of the back (not visible) surface of the pinna, and FIG. 6 illustrates long surface 54 touching the back (not visible) surface of the lower portion of the pinna. Depending on the shape and location of the ear, one of surfaces 52 and 54 can be selectively used to hold, with the ear bud, the headset in place on the user's ear.

As in FIG. 1, speaker capsule 44 is suspended from the upper portion of upper wing 42 and can be positioned over the opening of the concha. Ear bud 48 is coupled to speaker capsule 44 so as to float along an arc 56 formed on speaker capsule 44 and so as to self-center to the individual user's ear. That is, the floatation of ear bud 48 enhances the adjustment of ear bud 48 to various ear-shapes and concha locations. The voice tube, external microphone, and on-line indicators can be also integrated in headset 40.

Referring to FIGS. 5 and 6, when headset 40 is worn on the ear, lower wing 43 is pivotally moved down relative to body 41. Floating ear bud 48 self-centers on the concha of the ear, and the length of upper wing 42 is adjusted by the extension of upper wing 42, away from body 41. Then, lower wing 43 moves up relative to upper wing 42 until lower wing 43 touches the back surface of the lower portion of the pinna of the ear. As mentioned above, by rotating lower wing 43 about the longitudinal axis extending from one end to the other end of lower wing 43, either one of surfaces 52 and 54 may be supported by the back surface of the lower portion of the pinna of the user's ear. As in headset 10 of FIG. 1, ear bud 48 is plugged and fixed in the concha, and lower wing 43 presses against and thus is supported by the back surface of the lower portion of the pinna. The combination of the plugging of ear bud 48 and the support of lower wing 48 provides the stability that holds headset 40 on the ear. The rotation and up-and-down movement of lower wing 43, the. extension of upper wing 42, and the floating of ear bud 48 provide comfort in using headset 40, by allowing easy adjustment of headset 40 to the ear of the user.

FIGS. 7*a* to 7*f* show one embodiment of the headset of this invention as seen from six different views corresponding to the six sides of a cube placed around the headset. Microphone 5 and ear bud 8 are shown clearly in FIGS. 7*c* and 7*f*.

In summary the headsets of the present invention do not require the prior art ear hook that caused discomfort to users. In order to eliminate or reduce the discomfort and the complex adjustment in the traditional OTE headset, the headsets of the present invention employ a number of advantageous features for easy adjustment to various users. Such features include the lower wing that can rotate about its longitudinal axis and move up-and-down, the extendable upper wing, and the self-centering ear bud. These features allow the headset to adjust to and thus comfortably mount to a user's ear.

The invention has been described using exemplary embodiments. However, it is to be understood that the scope of the invention is not limited to the disclosed embodiments. On the contrary, various modifications and similar arrangements will be obvious to those skilled in the art in view of this disclosure. For example, the body and the upper wing of the headset can be integrated into one piece. The claims, therefore, should be accorded the broadest interpretation so as to encompass all such modifications and similar arrangements.

What is claimed is:

1. A headset comprising:

an upper wing having a first end and a second end; and a lower wing having a first end and a second end, the second end of the lower wing being coupled to the second end of the upper wing so that the lower wing pivotally moves up and down relative to the upper wing, the wings configured so that the upper wing is positioned substantially above the lower wing when the headset is worn on an ear, the upper wing including a speaker capsule so that the speaker capsule can be positioned near the ear, the upper wing further including an ear bud such that the ear bud is capable of being positioned on a concha of the ear, wherein the lower wing is capable of being brought into contact with a back surface of an outside pinna of the ear, and wherein the ear bud and the lower wing substantially secure the headset to the ear when worn.

2. The headset of claim 1, wherein the lower wing rotates around an axis extending from the first end to the second end of the lower wing.

3. The headset of claim 2, wherein the lower wing has a first surface and a second surface, said first surface of the lower wing is shaped to accommodate one type of ear, and said second surface of the lower wing is shaped to accommodate another type of ear.

4. The headset of claim 3, wherein the first surface is separated from the second surface by 180 degrees about a longitudinal axis extending from the first end to the second end of the lower wing.

5. The headset of claim 1, including a body coupling said upper wing to said lower wing, and wherein the upper wing is extendable relative to said body so that the car bud is capable of being positioned on the opening of the concha of the ear.

6. The headset of claim 1, wherein the car bud floats relative to the upper wing such that the ear bud can be positioned on the opening of the concha of the ear.

7. The headset of claim 1, wherein the car bud is integrated into the speaker capsule.

8. The headset of claim 1, further comprising an on-line indicator.

9. A headset comprising:

a body;

an upper wing extended from the body; and a lower wing extended from the body, the wings configured so that the upper wing is positioned substantially above the lower wing when the headset is worn on an ear, the upper wing including an speaker capsule so that the speaker capsule can be positioned near the car, the upper wing further including an ear bud such that the ear bud is capable of being positioned on an opening of a concha of the ear, wherein the lower wing moves up and down pivotally relative to the upper wing on an interface between the body and the lower wing and wherein the ear bud and the lower wing substantially secure the headset to the car when worn.

10. The headset of claim 9, wherein the lower wing has a first end and second end and a longitudinal axis extending from the first end to the second end; and wherein the lower wing is rotatable around said longitudinal axis.

11. The headset of claim 10, wherein the lower wing has a first surface and a second surface; and wherein said first surface of the lower wing is shaped to accommodate one type of ear, and said second surface of the lower wing is shaped to accommodate another type of ear.

12. The headset of claim 11, wherein said first surface is separated from said second surface by 180 degree rotation around said longitudinal axis of the lower wing.

13. The headset of claim 9, wherein the upper wing is further extendable from said body.

14. The headset of claim 9, further comprising a microphone embedded in said body.

15. The headset of claim 9, wherein said car bud floats to be positioned on the opening of the concha of the ear.

16. The headset of claim 9, wherein said ear bud is integrated into the speaker capsule.

17. The headset of claim 9, further comprising an on-line indicator.

18. The headset of claim 9 wherein said speaker capsule is rotatable at least 180° about an axis vertical relative to the user's ear thereby to allow the headset to be used on either the right or left ear of the user.

19. The headset of claim 9 wherein said speaker capsule has openings on two sides thereby to allow the headset to be placed on either car of the user.

20. The headset of claim 9 wherein said speaker capsule is rotatable about an axis approximately parallel to the longitudinal center line of said upper wing.

21. The headset of claim 9 wherein said speaker capsule is rotatable about an axis approximately perpendicular to a plane through the center lines of said upper wing and said lower wing.

22. The method of adjusting a headset comprising a body, an upper wing mounted to one portion of said body, said upper wing including a speaker capsule containing an ear bud, said ear bud being adjustable relative to said speaker capsule, and said upper wing being extendable from said body, and a lower wing mounted to another portion of said body, said lower wing having a first surface and a second surface, said lower wing being rotatable up or down relative to said upper wing about a pivot point on said body and being rotatable about a longitudinal axis extending from a first end to a second end of said lower wing; comprising placing said headset adjacent a user's ear;

extending the upper wing until the ear bud rests in the concha of the user's ear; and rotating the lower wing about the body relative to the upper wing until the lower wing has its first surface or second surface adjacent the back side of the pinna of the user's ear.

23. The method of claim 22 including rotating the lower wing about said longitudinal axis until the first surface or the second surface is adjacent the back surface of the pinna of the user's ear.

* * * * *